US006972361B2

(12) United States Patent
Shibamiya et al.

(10) Patent No.: US 6,972,361 B2
(45) Date of Patent: Dec. 6, 2005

(54) WOODWIND INSTRUMENT EQUIPPED WITH PAD SEALING MECHANISM AUTOMATICALLY ADJUSTABLE TO TONE HOLE

(75) Inventors: Jun Shibamiya, Shizuoka-ken (JP); Tsunehiko Fuse, Shizuoka-ken (JP); Ichi Sugawara, Shizuoka-ken (JP); Keisuke Tanaka, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 38 days.

(21) Appl. No.: 10/634,849

(22) Filed: Aug. 6, 2003

(65) Prior Publication Data

US 2004/0129128 A1 Jul. 8, 2004

(30) Foreign Application Priority Data

Aug. 7, 2002 (JP) ..... 2002-229462
Mar. 13, 2003 (JP) ..... 2003-068584

(51) Int. Cl.[7] ..... G10D 7/08
(52) U.S. Cl. ..... 84/385 P
(58) Field of Search ..... 84/385 P

(56) References Cited

U.S. PATENT DOCUMENTS 3,564,574 A * 2/1971 Singular ..... 84/380 R
4,158,979 A * 6/1979 Suzuki ..... 84/385 P
4,729,275 A * 3/1988 Elbaz ..... 84/385 P
5,381,718 A * 1/1995 Wasser ..... 84/385 P
5,469,771 A * 11/1995 Wasser ..... 84/385 P

FOREIGN PATENT DOCUMENTS

| | | |
|---|---|---|
| JP | 48-20027 | 6/1973 |
| JP | 48-20028 | 6/1973 |
| JP | 2001-142458 | 5/2001 |

OTHER PUBLICATIONS

Copy of Japanese Office Action dated May 10, 2005 (with English translation and comments of relevant portions).

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

A woodwind instrument has a key mechanism for selectively closing and opening tone hole chimneys formed on a tube, and the key mechanism includes keys supported by a linkage at the associated tone hole chimneys; each of the keys includes a retainer inserted between a pad cup and a pad, and the retainer has a backing plate portion held in area contact with at the inner surface thereof to the pad and in point contact with at the outer surface thereof to the pad cup so that an assembling worker adjusts the pad to an appropriate attitude in the pad cup by pressing the pad to the associated tone hole chimney, and, thereafter, secures the retainer to the pad cup; this results in that the player can seal the tone hole chimney with the pad through a simple adjusting work.

18 Claims, 5 Drawing Sheets

WOODWIND INSTRUMENT EQUIPPED WITH PAD SEALING MECHANISM AUTOMATICALLY ADJUSTABLE TO TONE HOLE

FIELD OF THE INVENTION

This invention relates to woodwind instruments and, more particularly, those types of woodwind instruments equipped with key mechanisms for closing tone holes.

DESCRIPTION OF THE RELATED ART

The woodwind instrument has a wide variety of family members such as, for example, flutes, recorders, clarinets, oboes, saxophones and bassoons. Although the word "woodwind" is a compound word between word "wood" and word "wind", the compound word "woodwind" does not imply the material of the wind instruments. The bassoons and clarinets are usually made of wood. However, the saxophones are made of metal. Several family members such as flutes are directly blown by players. On the other hand, players require reeds for other family members. The players blow the clarinets through reeds. Although the players generate vibrations of air columns in different manners, they are the family members of the woodwind instrument. Nevertheless, all the family members of woodwind instrument have tubes formed with tone holes, and the players selectively open and close the tone holes for changing the intonation of the tones. The tubes of recorders are not so long that the players can selectively open and close the holes with their fingers. However, the flutes, saxophones, oboes and bassoons have the tone holes, which are widely spaced from one another. The intervals are too long for the players to selectively open and close them with their fingers. For this reason, these family members require their own key mechanisms. The present invention appertains to those family members of the type having the key mechanisms.

A flute is, by way of example, broken down into a tube, which may be separable into plural parts, and a key mechanism. The tube is formed with a mouthpiece and tone holes. The mouthpiece is formed at one end portion of the tube, and the tone holes are arranged along the centerline of the tube toward the other end. The key mechanism includes plural keys, with which a player selectively opens and closes the tone holes for changing the pitch of the tones. Typical examples of the key mechanism are disclosed in Japanese Patent Application laid-open Nos. hei 07-104740, hei 10-161646 and 2001-134265.

FIG. 1 illustrates the prior art key 4 incorporated in the flute. The prior art key 4 is broken down into a pad 10, a pad cup 11 and a fastener 12. The pad cup 11 is formed of metal or alloy, and has a recess where the pad 10 is snugly received. The fastener 12 keeps the pad 10 in the recess, and prohibits the pad 10 from being unintentionally separated from the pad cup 11. A tone hole chimney 5 encircles one of the tone holes 2, and is rounded along the upper edge 5*a*. The pad 10 is pressed to the rounded edge 5*a* for closing the hole 2.

The pad 10 is to be air-tight, adaptable and durable. While a player is playing on the flute, the moist breath passes through the tube, and vents through the hole 2, which the player keeps opened. The pads 10 are expected to confine the moist air in the tube. If the breath is leaked through the pads 10, the tones become unstable, and the player feels the pitches, loudness and timbre unusual. In order hermetically to seal the breath in the tube, the pads are expected to adapt themselves to the rounded edge 5*a*. If the pads 10 are adaptable to the associated rounded edges 5*a*, any gap does not take place between the rounded edges 5*a* and the pads 10, and the air is surely confined in the tube. Thus, the pads 10 are to be adaptable and airtight.

The pads 10 are exposed to the moist air during the practice and performance. Although the player wipes the condensate from the inner wall of the tube 1 after the practice, the condensate is liable to be left on the pads 10. The pads 10 will be dried until the next practice, and exposed to the moist air, again. Thus, the pads 10 are repeatedly exposed to the moist air and dried thereafter. Although the moist air is unavoidable, the pads 10 are expected to maintain the adaptability and the air-tightness. If the pads 10 lose the adaptability and air-tightness within a short time, the player are to frequently change the pads 10 from the waste ones to new pieces. The exchange work is time-consuming, and players hate it. For this reason, the manufacture has developed durable pads.

From those viewpoints, the pad 10 is designed to have a core 10*a*/15 and a sealing layer 10*b*. A core 10*a* and a backing cardboard 15 as a whole constitute the core. The core 10*a*/15 imparts the adaptability to the pad 10, and the sealing layer 10*b* makes the pad 10 airtight. The backing cardboard 15 is made of paper, and the core layer 10*a* is made of air-permeable material such as compression felt. The backing cardboard 15 is overlaid with the core layer 10*a*, and the sealing layer 10*b* is fixed to the core layer 10*a* reverse to the backing cardboard 15. The sealing layer 10*b* is expected to hermetically seal the air column inside the tube. The sealing layer 10*b* is formed from skin or bladder, and is laminated on the core layer 10*a*. It is preferable to make the sealing layer 10*b* from sheepskin, calfskin and bladder of sheep or calf. The pad 10 is formed with a center hole.

The pad cups 11 are formed from a sheet of metal/alloy through a drawing. Each of the pad cups 11 has a wall portion 11*a* and a disc portion 11*b*. The wall portion 11*a* is merged into the periphery of the disc portion 11*b*, and defined the recess together with the disc portion 11*b*. The recess has an inner diameter substantially equal to the outer diameter of the pad 10 so that the pad 10 is snugly received in the recess. A dent 11*c* is put in the disc portion 11*b*, and permits the bulb of player's finger to rest therein. For this reason, the disc portion 11*b* has a convex surface in the recess.

A player directly depresses the pad cups 11 with his or her fingers, and pushes levers, which are connected through key rods to the other pad cups 11, with his or her thumb and fingers for selectively closing the tone holes 2. When the pad cup 11 is depressed, the prior art key 4 is moved in the direction indicated by arrow AR1, and closes the tone hole 2 with the pad 10. When the player removes the force from the pad cups 11 or the levers, return springs make the prior art key 4 open the tone hole 2.

The fastener 12 consists of a center nut 13, a bolt 14 and a pad washer 12*a*. The center nut 13 is brazed to the convex surface of the disc portion 11*b*, and an internal thread is formed along the centerline of the center nut 13. The center nut 13 has an open end surface 13*a*, and the end surface 13*a* is flat. The center nut 13 has a wide boss portion substantially equal in diameter to the hole formed in the backing cardboard 15, and the remaining portion is substantially equal in diameter to the core layer 10*a* and the sealing layer 10*b*. Thus, the center nut 13 is snugly received in the center hole of the pad 10.

The bolt 14 has a head portion 14*a* and a threaded stem portion 14*b*. The threaded stem portion 14*b* projects from the reverse surface of the head portion 14*a*. The reverse surface of the head portion 14*a* is also flat.

The pad washer 12*a* has major surfaces, which are also flat, and is formed with a hole at the center area thereof. The hole in the pad washer 12*a* has an inner diameter greater than the outer diameter of the threaded stem portion 14*b* so that the threaded stem portion 14*b* loosely passes through the hole formed in the pad washer 12*a*. The pad washer 12*a* has an outer diameter less than the outer diameter of the pad 10 and, accordingly, the inner diameter of the recess.

The prior art key 4 is assembled as follows. An assembling worker puts the pad 10 into the recess. The pad 10 passes through the center nut 13. Even though the pad 10 reaches the convex surface of the disc portion 11*b*, the flat end surface 13*a* still remains inside the center hole.

Subsequently, the assembling worker puts the pad washer 12*a* on the sealing layer 10*b*, and aligns the hole of the pad washer 12*a* with the hole of the center nut 13. The assembling worker inserts the threaded stem portion 14*b* into the center nut 13, and turns the bolt 14. The threaded step portion 14*b* is brought into threaded engagement with the center nut 13, and the bolt 14 is screwed into the center nut 13. The flat reverse surface of the head portion 14*a* is brought into area contact with the flat major surface of the pad washer 12*a*, and the head portion 14*a* is pressed against the pad washer 12. The pad washer 12*a* in turn presses the pad 10 to the convex surface of the disc portion 11*b*. Thus, the pad 10 is fastened to the pad cup 11 by means of the fastener 12.

Assuming now that the pad cup 11 was mistakenly brazed to the arm, the center line CL1 of the center nut 13 is inclined, and crosses the centerline CL2 of the tone hole chimney 5 by θ as shown in FIG. 2. If the pad 10 is retained by the pad cup 11 without any adjusting work, the pad 10 dines to the certain side. When a player depresses the key 4 to the tone hole chimney 5, the pad 10 is imperfectly brought into contact with the upper edge 5*a*, and gap takes place between the pad 10 and the tone hole chimney 5. This results in leakage of the breath. If the angle θ is not serious, the assembling worker regulates the inclination of the pad 10 by using adjusting shims 18.

The adjusting work on the prior art key 4 is carried out as follows. The assembling worker inserts an adjusting shim or shims 18 between the backing cardboard 15 and the pad cup 11. The adjusting shims 18 are made of paper, and have sectorial shape. The adjusting shims 18 make the pad 10 partially spaced from the inner surface of the pad cup 11. If the pad 10 is appropriately inclined on the opposite side by means of the adjusting shim 18, the adjusting shim or shims 18 keep the centerline CL2 of the tone hole chimney 5 to be normal to the pad 10, and the pad 10 is brought into contact with the entire rounded edge 5*a* of the tone hole chimney 5. However, the assembling worker usually repeats the adjusting work on the prior art key 4. The assembling worker increases or decreases the number of adjusting shims 18, and checks the prior art key 4 to see whether or not the gap still locally takes place between the pad 10 and the tone hole chimney 5. Thus, the adjusting work proceeds in a trial-and-error method. The trial-and-error method consumes time. Thus, the prior art key 4 requires the complicated and time-consuming adjusting work for making the pad 10 brought into contact with the entire round edge 5*a* of the tone hole chimney 5. This is the first problem inherent in the prior art key mechanism.

The second problem is that the breath is still leaked through some tone holes 2 after the complicated adjusting work. The present inventors investigated the prior art keys 4 which had imperfectly closed the tone holes 2, and found dents 16 locally formed in the pads 10. The present inventors further found that some sealing layers 10*b* were broken at the dents 16. The present inventors further investigated the cause of the local dents 16 and breakage, and notified that the pad washers 12*a* had been locally pressed against the pads 10. The present inventors concluded that the breath had been leaked through the dents 16.

Another prior art against the leakage is disclosed in Japanese Patent Application laid-open No. 2001-142458. According to the Japanese Patent Application laid-open, the assembling work proceeds as follows. The center nut has been already secured to the pad cup. First, liquid resin is poured into the pad cup, and a backing cardboard, which is made of cellular synthetic resin, and a pad are put into the pad cup. The worker turns the pad cup, and presses the pad to the periphery of the tone hole chimney. While the pad is being pressed against the periphery of the tone hole chimney, the liquid resin is solidified, and the center column and pad are bonded to the inner surface of the pad cup. The prior art disclosed in the Japanese Patent Application laid-open is similar to the prior art shown in FIG. 2 except the liquid resin instead of the adjusting shims 18.

Yet another prior art against the leakage is disclosed in Japan Patent Publication No. hei 3-50278. A ball joint is provided between the pad cup and the pad. A plate, which has a spherical protrusion, is secured to the inner surface of the pad cup, and the head portion of a rivet is formed with a spherical recess. The spherical protrusion is engaged with the spherical recess so as to permit the pad to incline in any direction. The rivet is further formed with pawls, and the pawls prevent the rivet from rotation.

The prior art disclosed in Japanese Patent Application laid-open No. 2001-142458 has the problem same as that of the prior art shown in FIGS. 1 and 2, because the adjusting shims 18 are merely changed to the liquid resin.

A problem inherent in the prior art disclosed in Japanese Patent Publication No. hei 3-50278 is poor operability of the pad. The pad is assumed to incline. When the player presses his or her finger the pad cup, the key turns toward the tone hole chimney, and the pad is partially brought into contact with the periphery of the tone hole chimney. The player further presses the finger to the pad cup. Then, the ball joint permits the pad to change its attitude in the pad cup, and makes the pad to be held in contact with the entire periphery of the tone hole chimney. Another problem is poor durability of the pad. The rivet holds the pad by means of a disc resonator. When the pad is pressed to the tone hole chimney, the disc resonator is deformed, and the periphery of the disc resonator is strongly pressed against the pad. The pad is liable to be broken. Thus, the pad is less durable.

SUMMARY OF THE INVENTION

It is therefore an important object of the present invention to provide a woodwind instrument, keys of which are adjusted to the appropriate attitude through a simple adjusting work.

To accomplish the object, the present invention proposes to automatically adjust a pad to an appropriate relative position to the pad cup before the pad is secured to the pad cup.

In accordance with one aspect of the present invention, there is provided a woodwind instrument for generating tones comprising a tube formed with plural tone holes for changing the pitch of the tones and a key mechanism provided on the tube and including a linkage secured to the tube and plural keys connected to the linkage for selectively close or open the tone holes, and each of the plural keys includes a pad cup having an inner surface defining a recess and connected to the linkage, a pad received in the recess and brought into contact with a part of the tube defining associated one of the tone holes, a retainer having an inner surface held in area contact with the pad and an outer surface held in point contact with the inner surface of the pad cup so as to permit the retainer to incline to any direction, a fastener connected to the retainer for keeping the pad held in area contact with the inner surface of the retainer and a coupler provided between the retainer and the pad cup for keeping the retainer in an appropriate attitude in the pad cup.

In accordance with another aspect of the present invention, there is provided a woodwind instrument for generating tones comprising a tube formed with plural tone holes for changing the pitch of the tones and a key mechanism provided on the tube and including a linkage secured to the tube and plural keys connected to the linkage for selectively close or open the tone holes, and each of the plural keys includes a pad cup having an inner surface defining a recess and connected to the linkage, a pad received in the recess and brought into contact with a part of the tube defining associated one of the tone holes, a retainer provided between the pad cup and the pad and having a backing plate portion held in area contact with the pad and a column portion projecting from the backing plate portion at an invariable direction, a fastener connected to the column portion for pressing the pad to the backing plate portion and a coupler provided between the retainer and the pad cup for keeping the retainer in an appropriate attitude in the pad cup.

BRIEF DESCRIPTION OF THE DRAWINGS

The features and advantages of the woodwind instrument will be more clearly understood from the following description taken in conjunction with the accompanying drawings, in which.

DESCRIPTION OF THE PREFERRED EMBODIMENTS

Concepts Employed in Key

In order to solve the first problem inherent in the prior art keys 4, the present inventors proposes to keep a pad assembly held in point contact with a pad cup in an adjusting work. An assembling worker is assumed to mistakenly braze the pad cup to an arm of a key mechanism. The assembling worker puts the pad assembly into a recess of the pad cup, and presses the pad assembly to a tone hole chimney, a part of a tube which defines a tone hole or a suitable jig. Even if the pad assembly inclines to any side, the tone hole chimney, the part of the tube or the jig automatically corrects the relative attitude between the pad and the pad cup, because they are in point contact. In other words, when the pad assembly is brought into contact with the tone hole chimney, part of the tube or jig, the reaction causes the pad assembly to roll on the pad cup, and the pad assembly and pad cup automatically enter the appropriate relative attitude for perfectly closing the tone hole. When the pad assembly enters the appropriate relative attitude, the pad assembly is secured to the pad cup by means of a coupler. The assembling worker is only expected to press the pad assembly in the pad cup to the tone hole chimney, part of the tube or jig. Thus, the adjusting work on the key according to the present invention is much simpler than the adjusting work on the prior art key 4.

The present inventors further propose to use a retainer instead of the backing cardboard 15 and center nut 13 for prevent a pad from a pad washer locally pressed thereto. The retainer has a backing plate portion, which is corresponding to the backing cardboard 15, and a column portion, which is corresponding to the center nut 13. The column portion has been adjusted to a predetermined angle on the backing plate portion. For example, the backing plate portion and column portion are monolithic. If the backing plate portion inclines to a certain direction, the column portion inclines together with the backing plate portion, and the angle therebetween is never varied. A pad is put on the backing plate portion, and a fastener is engaged with the column portion so as to keep the pad stable on the retainer. Even if the backing plate portion inclines to a certain direction on the inner surface of the pad cup, the column portion inclines together with the backing plate portion, and the fastener also inclines to the certain direction. As a result, the fastener is never locally pressed to the pad. Any dent is never formed in the pad, and breath is confined in a tube without any leakage. Those two concepts are realized in a preferred embodiment described hereinafter in detail.

First Embodiment

Figure 1:
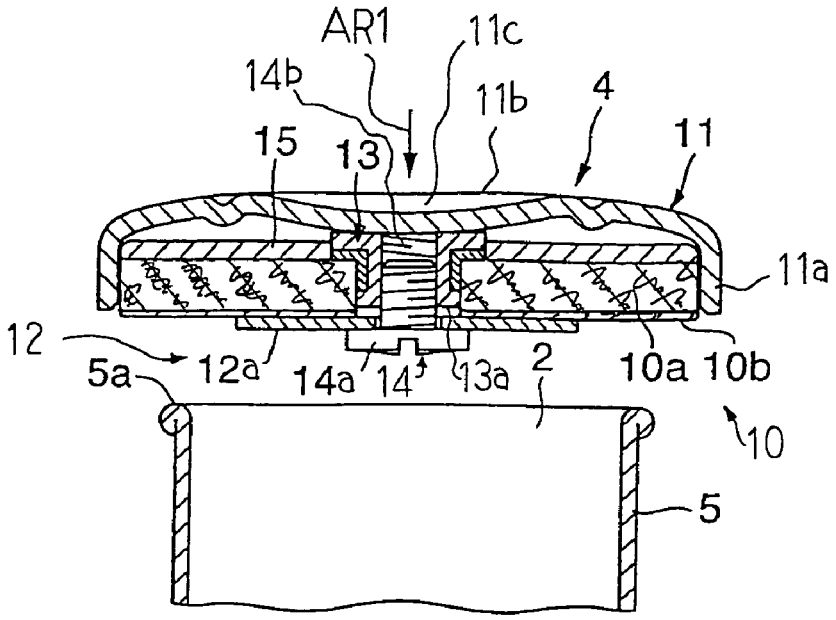
Fig. 1 PRIOR ART
FIG. 1 is a cross sectional view showing the structure of the prior art key incorporated in the flute.
Figure 2:
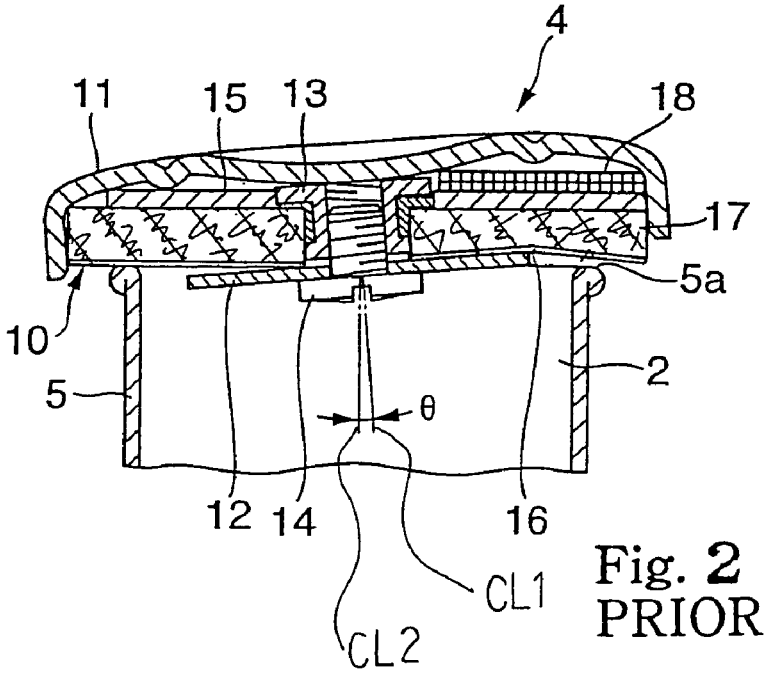
Fig. 2 PRIOR ART
FIG. 2 is a cross sectional view showing the prior art key mistakenly fixed to the arm.
Figure 3:
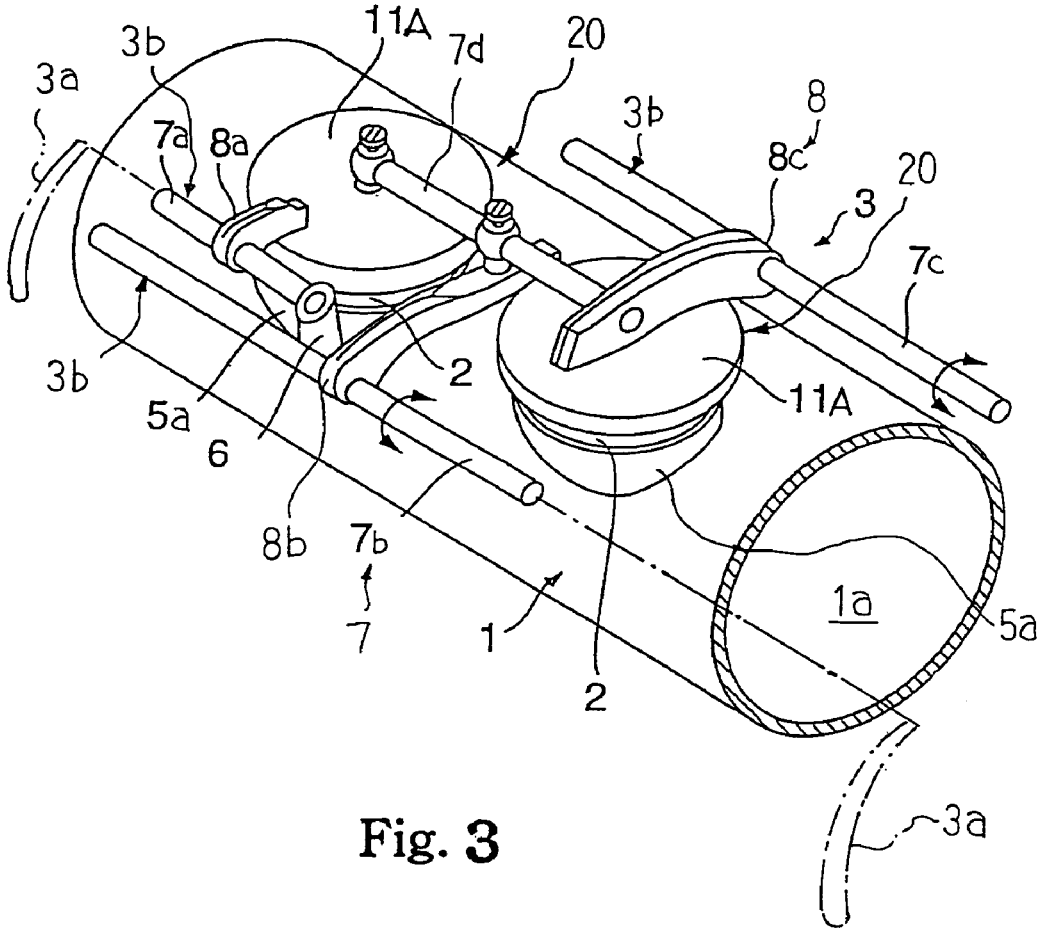
FIG. 3 is a schematic perspective view showing a part of a flute according to the present invention.

Referring to FIG. 3 of the drawings, a flute embodying the present invention comprises a tube 1 and a key mechanism 3. An inner space 1*a* is defined in the tube 1, and the tube 1 is formed with a mouthpiece (not shown) and tone holes 2. The mouthpiece is open to the atmosphere at one end portion of the tube 1, and the tone holes 2 are arranged toward the end portion. In the following description, term "upstream" is indicative of a position closer to the mouthpiece than a position modified with term "downstream". Namely, the tone holes 2 are arranged from the upstream side toward the downstream side along the tube 1. The inner space 1*a* is open to the atmosphere at the other end thereof, and is connected through the tone holes 2 to the atmosphere. The hole at the other end of the tube 1 is hereinbelow referred to as "end hole" in order to discriminate it from the tone holes 2.

Tone hole chimneys 5*a* are fixed to the tube 1, and project from the peripheries defining the tone holes 2. In other words, the tone holes 2 are encircled with the tone hole chimneys 5*a*. Although the tone holes 2 are three dimensionally curved on the tube 1, the tone hole chimneys 5*a* has flat circular ends, which are only two dimensionally curved. Thus, the tone hole chimneys 5*a* change the tone holes 2 from the three-dimensionally curved circles to the flat circles. The tone hole chimneys 5*a* form parts of the tube 1.

The key mechanism 3 is provided on the tube 1, and a player selectively opens and closes the tone holes 2 by manipulating the key mechanism 3. The tone holes 2 are respectively assigned to the notes of a scale, and the length of the air column is defined by the end hole or an open hole 2 closest to the mouthpiece. Thus, the player selectively changes the tone from a certain pitch to another pitch by manipulating the key mechanism 3.

The key mechanism 3 includes plural levers 3*a*, transmission devices 3*b* and keys 20. In this instance, the plural levers 3*a* and transmission devices 3*b* as a whole constitute a linkage. Key posts 6, key rods such as 7*a*/7*b*/7*c*/7*d* and arms 8*a*/8*b*/8*c* are assembled into the transmission devices 3*b*. Although particular key rods are labeled with those references 7*a*/7*b*/7*c*/7*d*, general reference 7 is indicative of a certain or any one or ones of the key rods on the tube 1. Similarly, general reference 8 is indicative of a certain or any one or ones of the arms on the tube 1. The key posts 6 are fixed to the outer surface of the tube 1, and the key rods such as 7*a*/7*b*/7*c* are rotatably supported by the associated key posts 6. The levers 3*a* are connected to selected ones of the key rods 7, and return springs (not shown) always urge the key rods 3*c* to rotate in the direction to close the tone holes 2.

The keys 20 are selectively fixed to the key rods 7 directly or by means of the arms 8, and are respectively associated with the tone holes 2. The return springs (not shown) urge the key rods 3*c* to keep the keys 20 spaced from the tone hole chimneys 5*a*. When a player pushes a lever 3*a*, the lever 3*a* drives the key rod 7 for ration against the elastic force of the return spring (not shown), and the key rod 7 brings the associated key or keys 20 into contact with the tone hole chimney or chimneys 5*a*. Then, the tone hole or holes 2 are closed with the key or keys 20 so that the flute changes the length of vibrating air column. Some keys 20 are directly pushed with player's fingers for closing the associated tone holes 2.

Some key rods 7 are in a master-slave relation. These key rods 7 are coupled to the associated key rods 3*c*, and the rotation is transmitted only from the master key rods 7, which are driven for rotation by a player, to the slave key rods 7. However, the rotation is not transmitted vise versa. The arms 8 are fixed to the certain key rods 7, and are connected to other key rods 7 at the other ends. The arms 3*d* transmit torque from the certain key rods 7 to the other key rods 7 so that the player can concurrently actuate plural transmission devices 3*b* by manipulating only one lever 3*a*. The master-slave key rods 7 and arms 8 permit a player sequentially to space the keys 20 from the tone holes 2 so as stepwise to change the pitch of the tones.

While a player is performing a piece of music on the flute, he or she breathes the air into the mouthpiece, and gives rise to vibrations of air column. The player tongues, and selectively opens and closes the tone holes 2 through the key mechanism 3. The vibrating air column is shortened and/or lengthened in response to the fingering on the key mechanism 3, and, accordingly, the pitch is changed.

Figure 4:
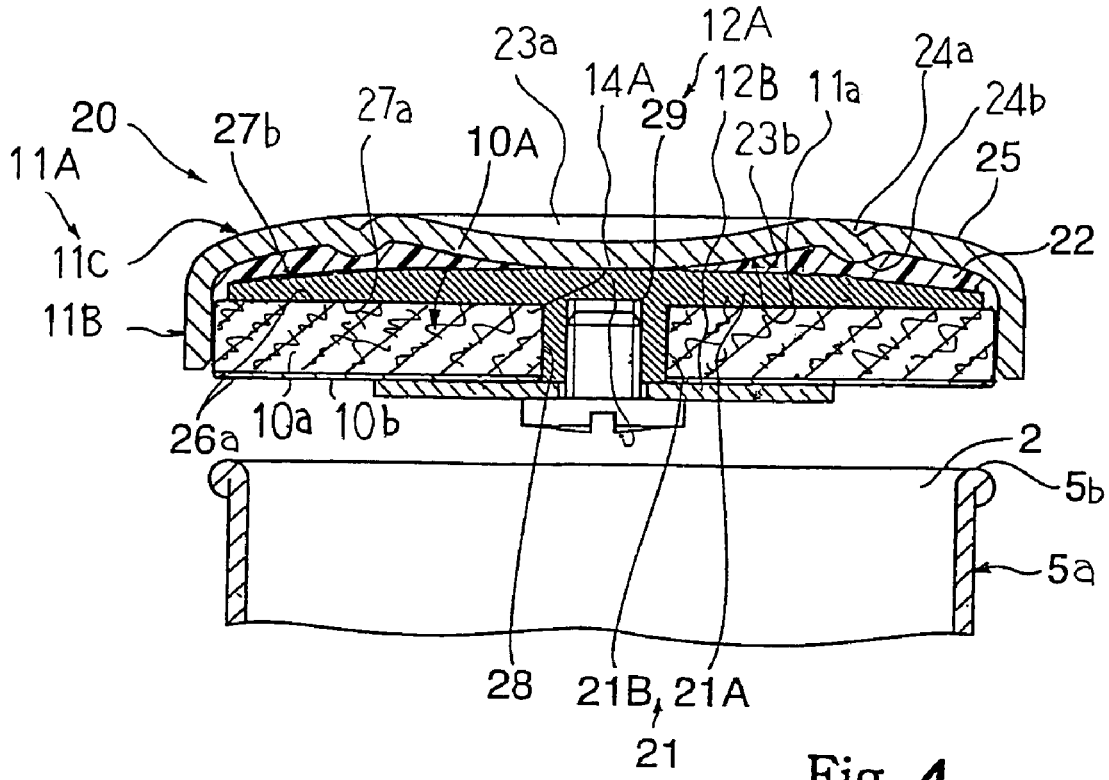
FIG. 4 is a cross sectional view showing the structure of a key incorporated in the flute.

FIG. 4 illustrates one of the keys 20 incorporated in the key mechanism 3. The key 20 includes a pad 10A, a pad cup 11A, a fastener 12A, a retainer 21 and a coupler 22. The pad 10A is adaptable, air-tight and durable, and has a ring shape. The flat major surfaces of the ring-shaped pad 10A are labeled with 26*a*. The pad cup 11A is formed with a recess, and the inner surface 11*a*, which defines the bottom of the recess, is waved. The retainer 21 has a flat inner surface 27*a* and a spherical outer surface 27*b*. The flat inner surface 27*a* is held in area contact with the flat major surface 26*a* of the pad 10A, and, accordingly, the retainer 21 keeps the pad 10A stable thereon. On the other hand, the spherical outer surface 27*b* is held in point contact with the waved surface 11*a* of the pad cup 11A. For this reason, the retainer 21 easily changes the attitude on the waved surface 11*a*. In other words, although the retainer 21 has been fixed to the pad cup 11A, the retainer 21 and pad cup 11A could vary the contact point before the fixation. The retainer 21 is secured to the pad cup 11A by means of the coupler 22. On the other hand, the pad 10A is secured to the retainer 21 by means of the fastener 12A. When the retainer 21 inclined on the waved surface 11*a*, the pad 10A and fastener 12A inclined together with the retainer 21.

An assembling worker sought the optimum contact point at which the centerline CL3 of the tone hole chimney 5*a* was normal to the flat major surface 26*a* of the pad 10 when the pad 10A was brought into contact with the associated tone hole chimney 5*a*. When the assembling worker found the optimum contact point, the assembling worker secured the retainer 21 to the pad cup 11A. For this reason, the individual keys 20 have the pads 10A to be brought into contact with the entire peripheries of the associated tone hole chimneys 5*a* without any gap. Thus, the keys 20 surely prevent the tone holes 2 from any leakage of breath.

The pad 10A has a laminated structure, and includes a core layer 10*a* and a sealing layer 10*b*. The core layer 10*a* is made of air-permeable material such as compression felt, and imparts the adaptability to the pad 10A. On the other hand, the sealing layer 10*b* makes the pad 10*b* airtight. The sealing layer 10*b* is made of skin or bladder, and is fixed to the core layer 10*a*. The sealing layer 10*b* is expected to hermetically seal the air column inside the tube 1. It is preferable to make the sealing layer 10*b* from a sheet of sheepskin, a sheet of calfskin or bladder of sheep or calf. Thus, the pad 10A is similar to the pad 10 incorporated in the prior art key 4.

The pad cup 11A is made from a sheet of metal or alloy through a drawing, and has a shape like a shallow cup. The pad cup 11A is broken down into a disc portion 11B and a peripheral wall portion 11C. The peripheral wall portion 11C downwardly projects from the gently curved periphery 25 of the disc portion 11B, and defines the recess together with the disc portion 11B. Thus, the pad cup 11A is used as if the shallow cup is turned over. The recess is approximately equal in diameter to the ring-shaped pad 10A, and is slightly greater in diameter than the retainer 21. The disc portion 11A is formed with a dent 23*a* and a circular groove 24*a*. The dent 23*a* occupies a central area of the pad cup 11A, and makes the corresponding area 23*b* of the inner surface 11*a* spherical. The circular groove 24*a* occupies an intermediate area around the dent 23, and forms a ridge 24*b* around the spherical area 23*b*. Thus, the spherical area 23*b* and ridge 24*b* form the waved surface 11*a*. The dent 23*a* permits the bulb of player's finger to rest therein.

The retainer 21 is made of synthetic resin, metal or alloy, and is broken down into a backing plate portion 21A and a center nut portion 21B. The center nut portion 21B serves as the column. The backing plate portion 21A is slightly smaller in diameter than the ring-shaped pad 10A, and the inner diameter of the ring-shaped pad 10A is approximately equal to the outer diameter of the center nut portion 21B. For this reason, the center nut portion 21B is snugly received in the center hole of the ring-shaped pad 10A. The backing plate portion 21A has the flat inner surface 27*a* and the spherical outer surface 27*b*, and the center nut portion 21B projects from the flat inner surface 27*a*. Although the backing cardboard 15 and center nut 13 are physically separable component parts of the prior art key 4, the backing plate portion 21A and center nut portion 21B are monolithic in the key 20 according to the present invention. In other words, the center nut portion 21B inclines together with the backing plate portion 21A, and the angle between the backing plate portion 21A and the center nut portion 21B is never varied. The center nut portion 21B has the height slightly less than the thickness of the pad 10A. The major flat surface 26*a* is to be held in area contact with the flat inner surface 27*a*.

The fastener 12A includes a female screw 29 formed inside the center nut portion 21B, a bolt 14A and a pad washer 12B. The male screw of the bolt 14A is brought into threaded engagement with the female screw, and the bolt 14A is screwed into the center nut portion 21B. The pad washer 12B has a shape like a ring. The pad washer 12B has the inner diameter, which is slightly larger than the outer diameter of the threaded stem of the bolt 14A and smaller than the outer diameter of the center nut portion 21B. Thus, the bolt 14A passes through the pad washer 12B, and presses the pad washer 12B to the pad 10A until the head portion is brought into contact with the center nut portion 21B. When the head portion is brought into contact with the center nut portion 21B, the pad 10A is resiliently compressed, and is sandwiched between the backing plate portion 21A and the head portion of the bolt 14A.

A piece of adhesive compound serves as the coupler 22. The adhesive compound is liquid, and is spread over the waved surface 11*a*. The pad 10A is put on the liquid adhesive compound, and the liquid adhesive compound is sandwiched between the waved surface 11*a* and the spherical outer surface 27*b*. When the liquid adhesive compound is solidified, the retainer 21 is secured to the pad cup 11A.

Figure 5:
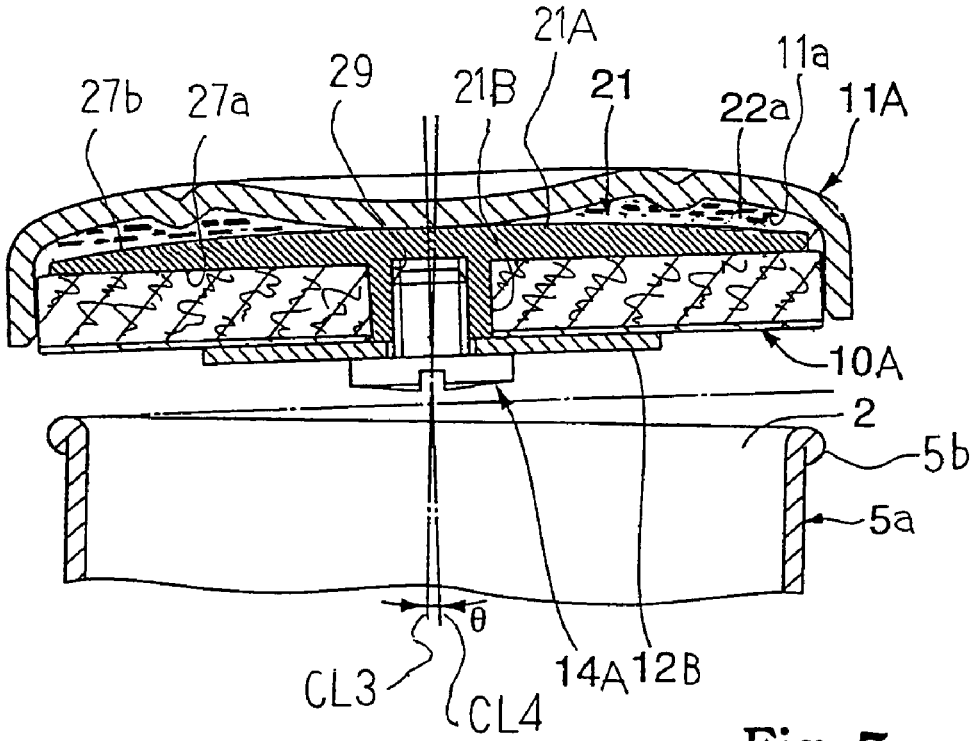
FIG. 5 is a cross sectional view showing the key mistakenly brazed to an arm.

The pad 10A, pad cup 11A, retainer 21 and fastener 12A are assembled into the key 20 as follows. The pad cup 11A has been already brazed to the associated arm 8. The pad cup 11A is assumed to be improperly brazed to the arm 8. The pad cup 11A inclines to one side, and the centerline CL4 of the center nut portion 21B crosses the centerline CL3 of the tone hole chimney 5*a* at a certain angle θ as shown in FIG. 5. It is difficult to separate the pad cup 11A from the arm 8. However, the certain angle θ is not serious. The worker decides to take up the angle θ through the assembling work.

The assembling worker aligns the center nut portion 21B with the hole of the pad 10A, and inserts the center nut portion 21B into the hole. The pad 10A is brought into contact with the flat inner surface 27*a*. The assembling worker puts the pad washer 12B on the pad 10A, and makes the hole of the pad washer 12B with the threaded recess of the center nut portion 21B. The assembling worker screws the bolt 14A into the center nut portion 21B. The head portion of the bolt 14A is brought into contact with the pad washer 12B, and presses the pad 10A to the flat inner surface 27*a*. Thus, the pad 10A is sandwiched between the back plate portion 21A and the pad washer 12B, and the pad 10A is secured to the retainer 21 by means of the fastener 12A. The pad 10A, retainer 21 and fastener 12A thus assembled are hereinafter referred to as "pad assembly".

Subsequently, the assembling worker pours the liquid adhesive compound 22*a* in the recess of the pad cup 11A, and inserts the pad assembly 10A/21/12A into the recess of the pad cup 11A. The retainer 21 is rolled on the spherical area 23*b*, because the adhesive compound 22*a* has not been solidified, yet. The liquid adhesive compound 22*a* is never leaked from the recess, because the pad 10A is snugly received in the recess.

Figure 6:
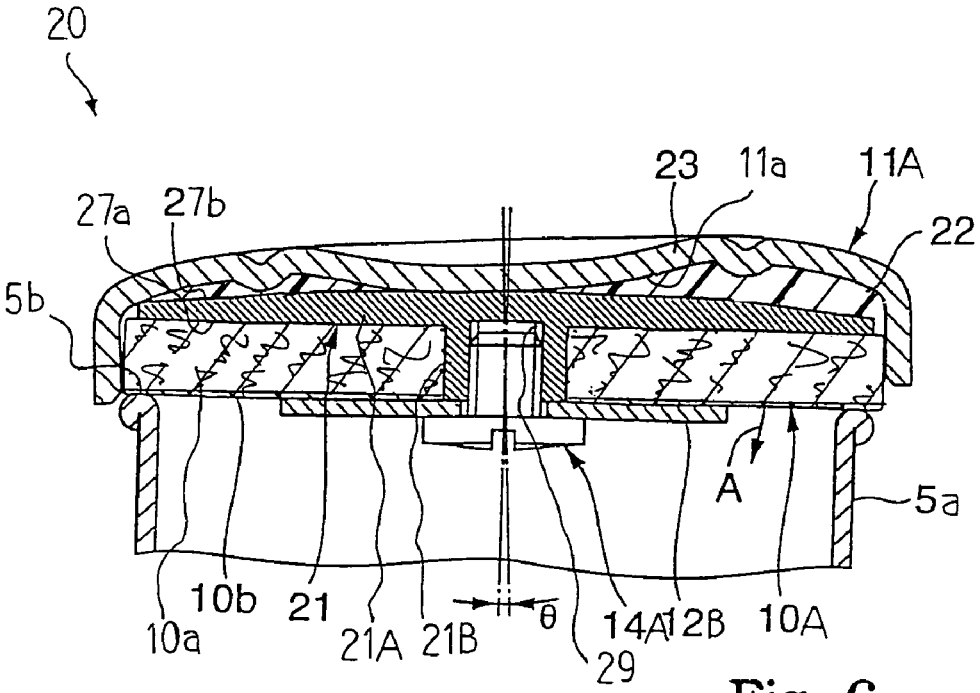
FIG. 6 is a cross sectional view showing the key with a pad corrected in attitude.

The assembling worker urges the pad cup 11A toward the tone hole chimney 5*a*, and brings the pad 10A into contact with the rounded periphery 5*b*. Even though the pad 10A inclines to one side as shown in FIG. 5, the reaction makes the retainer 21 roll on the spherical area 23*b*, and the pad assembly 10A/21/12A automatically changes the attitude in the pad cup 11A. The pad 10A is held in contact with the entire periphery of the tone hole chimney 5*a* as shown in FIG. 6.

The assembling worker continuously exerts the force on the pad cup 11A, and keeps the pad 10A held in contact with the entire periphery of the tone hole chimney 5*a* until the adhesive compound 22*a* is solidified. A spring, which always urges the key rod 7 in the direction to close the tone hole 2 with the pad 10A, may keep the pad 10A held in contact with the entire periphery of the tone hole chimney 5*a*. The adhesive compound 22 is solidified, and the pad assembly 10A/21/12A is secured to the pad cup 11A in the appropriate attitude.

As will be appreciated from the foregoing description, the backing plate portion 21A is held in point contact with the spherical area 23*b* on the waved surface 11*a* of the pad cup 11A, and the retainer 21 is secured to the pad cup 11A after the adjusting work, i.e., the pad assembly is pressed to the tone hole chimney 5*a*. Even if the pad cup 11A is improperly brazed to the arm 8, the assembling worker adjusts the pad assembly 10A/21/12A to the appropriate attitude to the pad cup 11A by simply pressing the pad assembly to the periphery of the tone hole chimney 5*a*. Thus, the retainer 21 makes the adjusting work simpler and easier than the adjusting work on the prior art key 4.

Moreover, the backing plate portion 21A and center nut portion 21B are monolithic, and, accordingly, the center nut portion 21B keeps itself at right angle to the backing plate portion 21A. Even if the backing plate portion 21A rolls on the spherical surface 23*b* of the pad cup 11A, the angle between the backing plate portion 21A and the center nut portion 21B is unchanged. The pad washer 12B is bolted to the center nut portion 21B at right angle. This results in that the pad washer 12B is always in parallel to the backing plate 21A. For this reason, the pad washer 12B is sandwiched between the backing plate portion 21A and the pad washer 12B, which is parallel to the backing plate portion 21A. The pad washer 12B is not locally pressed to the pad 10A, and any dent is never formed in the pad 10A. Thus, a player can perfectly close the tone hole 2 with the keys 20 according to the present invention.

Second Embodiment

Figure 7:
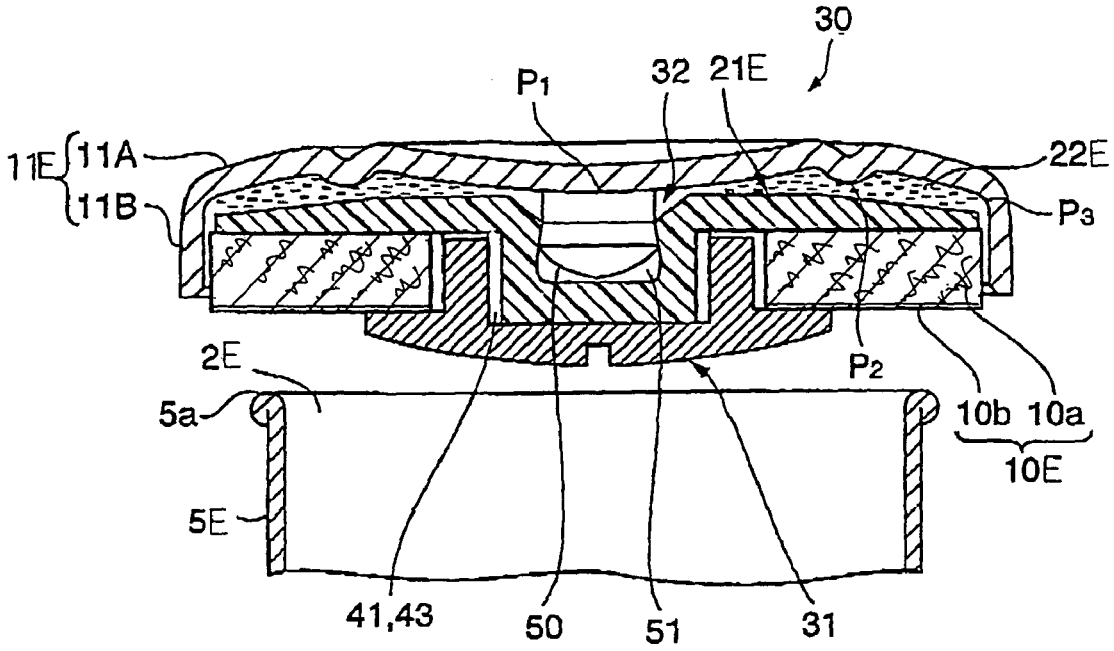
FIG. 7 is a cross sectional view showing the structure of another key according to the present invention.
Figure 8:
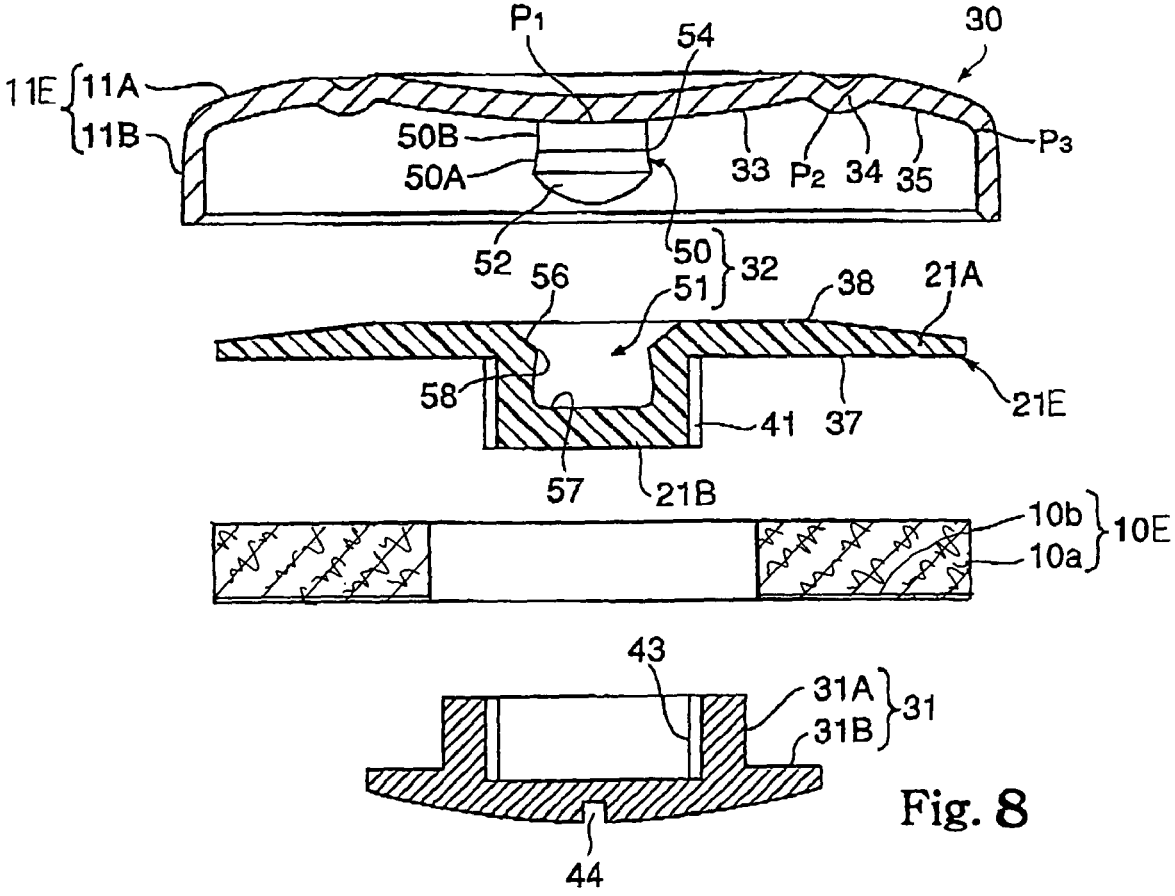
FIG. 8 is a fragmentary cross sectional view showing the parts of the key.

Turning to FIGS. 7 and 8 of the drawings, another key embodying the present invention is designated by reference numeral 30. A player closes and opens the tone hole 2E, which is defined by a tone hole chimney 5E, with the key 30.

The key 30 includes a pad 10E, a pad cup 11E, a fastener 31, a retainer 21E, a coupler 22E and a joint 32. The retainer 21E is put in the pad cup 11E, and the pad 10E is secured to the retainer 21E by means of the fastener 31. The retainer 21E is movably connected to the pad cup 11E by means of the joint 32, and is bonded to the inner surface of the pad cup 11E by means of the coupler 22E. The joint 32 permits the retainer 21E to change its attitude with respect to the tone hole chimney 5E, and the retainer 21E is bonded to the inner surface of the pad cup 11E after the adjustment of the attitude to the tone hole chimney 5E. In this instance, adhesive compound in the epoxy resin series is used as the coupler 22E.

The pad 10E is adaptable, air-tight and durable, and has a ring shape. The pad 10E has the two-layered structure 10*a*/10*b* as similar to the pad 10A incorporated in the key 20. For this reason, no further description is hereinafter incorporated for the sake of simplicity.

The pad cup 11E is made of metal or alloy such as, for example, stainless steel, and formed with a recess. In other words, the pad cup 11E is broken down into a bottom portion 11A and a side wall portion 11B, and the side wall portion 11B extends along the periphery of the bottom portion 11A. The stainless steel plate is shaped into the pad cup 11E through a drawing. The bottom portion 11A has a convex sub-portion 33, a ridge 34 and a curved subportion 35 so that the inner surface, which defines the bottom of the recess, is waved. The convex sub-portion 33, the ridge 34 and the curved sub-portion 35 have a vertex P1, a ridgeline P2 and a boundary P3 between the curved sub-portion and the side wall 11B. The vertex P1 is closer to the opening of the pad cup 11E than the ridgeline P2 and the boundary P3.

The retainer 21E is made of synthetic resin such as, for example, ABS resin. The retainer 21E is broken down into a disc portion 21A and a column portion 21B, and the column portion 21B projects from the center of the disc portion 21A. The disc portion 21A has a flat surface 37 and a reverse surface 38, and a sloop makes the disc portion 21A decreased in thickness toward the periphery. The disc portion 21A is slightly smaller in diameter than the pad 1E, and the column portion 21B is much smaller in diameter than the hole of the ring-shaped pad 10E. The flat inner surface 37 is held in area contact with the flat major surface of the pad 10E, and, accordingly, the retainer 21E keeps the pad 10E stable thereon. On the other hand, the sloop 38 makes the disc portion 21A decreased in thickness toward the periphery of the disc portion 21A. For this reason, the retainer can 21E change the attitude on the waved inner surface in so far as the adhesive compound 22E is not solidified. The column portion 21B is formed with a male thread 41, and has an outer diameter slightly less than the inner diameter of the ring-shaped pad 10E. For this reason, the column portion 21B passes through the ring-shaped pad 10E, and the flat inner surface 37 is brought into contact with the flat major surface of the ring-shaped pad 10E. The retainer 21E is secured to the pad cup 11A by means of the coupler 22E. On the other hand, the pad 10E is secured to the retainer 21E by means of the fastener 31.

The fastener 31 is made of metal or alloy such as stainless steel, and includes a stem 31A and a head 31B. A recess is open to the end surface of the stem 31A, and a female thread 43 is formed in the inner surface portion defining the recess. The outer diameter of the stem 31A is smaller than the hole of the ring-shaped pad 10E, and the recess is equal in diameter to the column portion 21B. A groove 44 is formed in the head portion 31B, and a tip of a screw driver is to be inserted into the groove 44. While the fastener 31 is being driven for rotation on the column portion 21B, the head 31B gets closer and closer to the disc portion 21A, and presses the pad 10E to the disc portion 21A.

The joint 32 is implemented by a boss 50 and a recess 51. The boss 50 is brazed to the pad cup 11E. The boss 50 projects from the center of the convex portion 33, and has a head 50A and a neck 50B. The neck 50B is fixed to the convex portion 33, and is constant in diameter. The head 50A is increased in diameter from the neck 50B toward a spherical top surface 52, and the boundary between the neck 50B and the head 50A is designated by reference numeral 54.

The recess 51 is formed in the retainer 21E. The recess 51 is open to the central area of the surface 38, and penetrates into the column portion 21B. The recess 51 has a mouth portion 56 and a bottom portion 57. The mouth portion is defined by a tapered surface 56 so that the inner diameter is decreased toward the boundary 58 between the mouth portion 56 and the bottom portion 57, and the bottom portion 57 is increased in inner diameter from the boundary 58 toward the bottom of the recess 51. Thus, the inner diameter of the recess 51 is minimized at the boundary 58. The inner diameter at the boundary 58 is slightly smaller than the maximum outer diameter of the head 50A. The bottom of the recess 51 is flat.

Those parts 10E/11E/21E/31 are assembled into the key 30 as follows. The boss 50 has been already brazed to the center area of the convex 33. A worker firstly puts the retainer 21E into the pad cup 11E, and aligns the recess 51 with the boss 50.

Subsequently, the worker pushes the retainer 21E toward the pad cup 11E. Then, the boss 50 penetrates into the recess 51, and the head 50A is brought into contact with the tapered surface of the mouth portion 56. The worker presses the retainer 21E against the boss 50. Then, the inner surface portion of the retainer 21E is resiliently deformed, and permits the head 50A to penetrate into the bottom portion 57. The boundary 58 is in contact with the boundary 54, and the resiliency of the ABS resin permits the boss 50 to move in the recess 51 without separation between the boss 50 and the retainer 21E.

Subsequently, the worker aligns the column portion 21B with the hole of the ring-shaped pad 10E, and moves the ring-shaped pad 10E toward the disc portion 21A. The column portion 21B is inserted into the hole, and the major surface of the pad 10E is brought into contact with the flat surface 37.

Subsequently, the worker aligns the stem 31A of the fastener 31 with the ring-shaped groove formed between the column portion 21B and the pad 10E, and drives the fastener 31 for rotation with the tool. Then, the male screw 41 is brought into threaded engagement with the female screw 43, and the head 31B presses the ring-shaped pad 10E to the flat surface 37 of the retainer 21E.

Figure 9A:
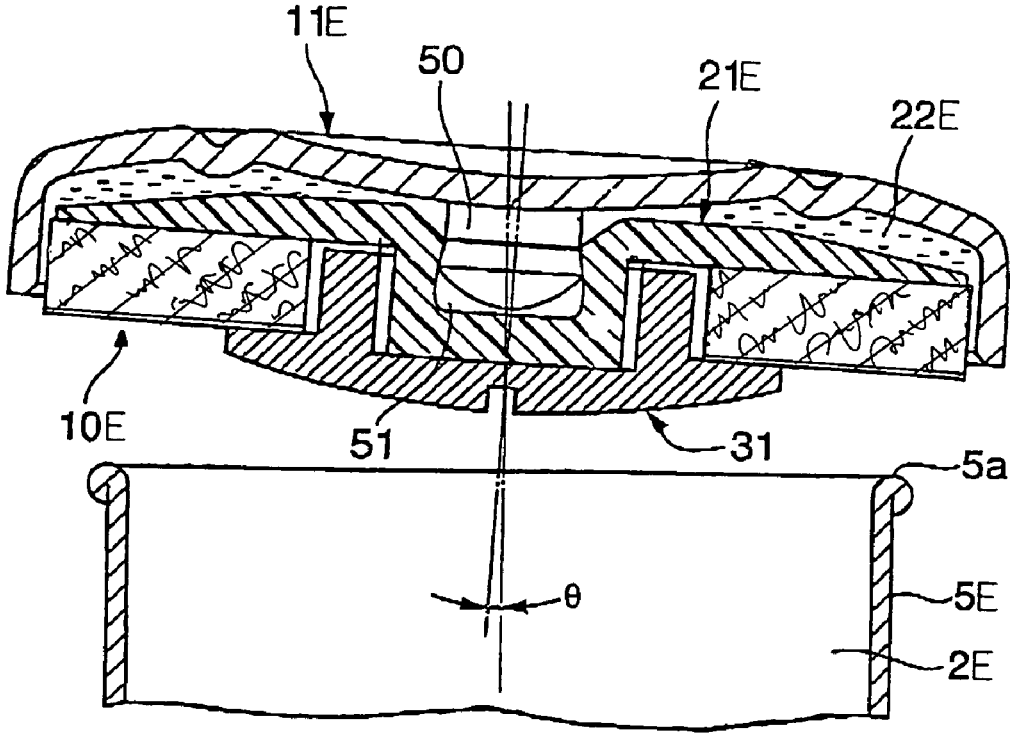
FIGS. 9A and 9B are cross sectional view showing two steps in an assembling work.

Subsequently, the worker injects the liquid adhesive compound 22E into the gap between the pad cup 11E and the retainer 21E. If the pad cup 11E inclines at angle θ with respect to the periphery 5*a* of the tone hole chimney 5E, the pad 10E also inclines at θ with respect to the tone hole chimney 5E as shown in FIG. 9A.

Figure 9B:
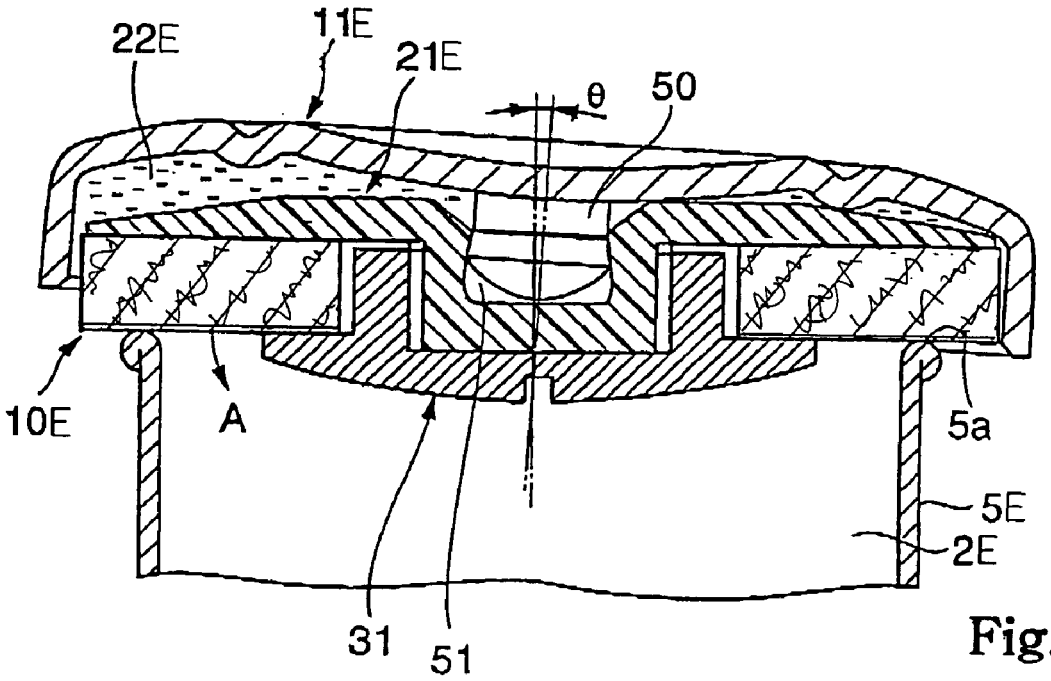

The worker pushes the pad cup 11E so as to make the pad 10E brought into contact with the periphery 5*a* of the tone hole chimney 5E. Even if a part of the pad 10E is brought into contact with a part of the periphery 5*a*, the worker presses the pad 10E against the tone hole chimney 5E. Then, the joint 32 permits the retainer 21E and, accordingly, the pad 10E to change the attitude in the pad cup 11E. As a result, the pad 10E becomes held in contact with the entire periphery 5*a* of the tone hole chimney 5E as shown in FIG. 9B. Although the retainer 21E inclines at angle θ with respect to the pad cup 11E, the retainer 21E and, accordingly, the pad 10E have the centerlines coincident with the centerline of the tone hole chimney 5E. The worker keeps the pad 10E held in contact with the periphery 5*a* of the tone hole chimney 5E until the adhesive compound 22E is solidified. A suitable jig may be used for keeping the pad 10E held in contact with the entire periphery 5*a*.

When the adhesive compound 22E is solidified, the retainer 21E can not change the attitude so that a player can perfectly close the tone hole 2E with the key 30.

As will be understood from the foregoing description, the joint 32 makes the retainer 21E held in point-to-point contact with the pad cup 11E so that the pad 10E can change the attitude to the pad cup 11E. The worker preliminary adjusts the pad 10E into the appropriate attitude before the adhesive compound fixes the retainer 21E to the pad cup 11E so that the player always perfectly closes and opens the tone hole 2E with the key 30.

Another advantage of the second embodiment is that the joint 32 prevents the retainer 21E from dropping out when the piece of adhesive compound 22E is cracked in future.

The assembling work does not proceed in the trial and error method, and is becomes easier and simpler than that of the prior arts.

Although particular embodiments of the present invention have been shown and described, it will be apparent to those skilled in the art that various changes and modifications may be made without departing from the spirit and scope of the present invention.

For example, the present invention is applicable to another sort of woodwind instrument such as, for example, a piccolo, saxophones, recorders, a clarinet, a bassoon, an oboe and etc. The woodwind instrument may be equipped with an electronic sound generator for generating electronic tones instead of acoustic tones.

The backing plate portion 21A may have a flat outer surface instead of the spherical outer surface 27*b*. The flat outer surface permits the retainer 21 to easily vary the attitude on the waved surface 11*a*. Thus, the spherical outer surface 27*b* does not set any limit to the technical scope of the present invention. Similarly, the spherical area 23*b* does not set any limit to the technical scope of the present invention. A needle or needles may project from the inner surface of a pad cup. In this instance, the outer surface of a retainer is held in point contact with the needle or needles so that the retainer inclines to any direction on the needle or needles under the application of the reaction from the tone hole chimney, part of the tune or jig. The needle or needles may be formed on the outer surface of the retainer.

The term "point contact" means that the retainer can incline to any direction on the inner surface of the pad cup upon application of the reaction from the tone hole chimney, part of the tune or jig. Even though the contact area between the retainer and the pad cup has a finite value, the retainer and pad cup are held in point contact in so far as the reaction can cause the retainer and the pad cup to change the relative attitude therebetween. On the other hand, the term "area contact" means that the pad is stable on the inner surface 27*a* of the retainer 21. In other words, the pad and retainer, which are held in area contact with each other, hardly change the relative attitude therebetween.

The monolithic structure does not set any limit on the technical scope of the present invention. The backing plate portion and center nut portion may be prepared separately. In this instance, the center nut portion is fixed to the backing plate portion at the appropriate angle before the assembling work. The important feature is that the backing plate portion and center nut portion do not change the angle in the adjusting work.

The retainer may have a column portion instead of the center nut portion. The word "nut" implies that the bolt is used as the fastener. However, a rivet, a clip, a pin, adhesive compound or solder may be used as a part of the fastener. These sorts of fastener do not need any female screw, and the pad washer is secured to the column by means of one of those sorts of fastener.

The adhesive compound 22 does not set any limit on the technical scope of the present invention. A piece of magnet, which is embedded in the retainer or pad cup, may serve as the coupler. The retainer may be soldered after the adjusting work. In this instance, the solder serves as the coupler.

The pad washer 12B may be fixed to the bolt 14A before the adjusting work. In this instance, the composite part of the pad washer and bolt and the female screw 29 as a whole constitute the fastener.

The levers 3*a* may not be incorporated in a key mechanism. In this instance, the player selectively closes and opens the tone holes with his or her fingers. In this instance, the transmission devices serve as the linkage.

The multi-layered structure of the pad 10A does not set any limit to the technical scope of the present invention. A pad may be a single layer.

The shape of the boss 50 does not set any limit to the technical scope of the present invention. The boss may have a spherical configuration.

In the second embodiment, the retainer 21E and the inner surface defining the recess 51 as a hole constitute a retainer used in claims. On the other hand, the boss 50 forms a part of the pad cup 11E.

What is claimed is:

1. A woodwind instrument for generating tones, comprising:

a tube formed with plural tone holes for changing the pitch of said tones; and a key mechanism provided on the tube, and including a linkage secured to said tube and plural keys connected to said linkage for selectively close or open said tone holes, each of said plural keys including a pad cup having an inner surface defining a recess and connected to said linkage, a pad received in said recess and brought into contact with a part of said tube defining associated one of said tone holes, a retainer having an inner surface held in area contact with said pad and an outer surface held in point contact with said inner surface of said pad cup so as to permit said retainer to incline to any direction, a fastener connected to said retainer for keeping said pad held in area contact with said inner surface of said retainer and a coupler provided between said retainer and said pad cup for keeping said retainer in an appropriate attitude in said pad cup.

2. The woodwind instrument as set forth in claim 1, in which said outer surface of said retainer is spherical so as to be held in point contact with said inner surface of said pad cup.

3. The woodwind instrument as set forth in claim 1, in which said inner surface of said pad cup has a spherical area so that said outer surface of said retainer is held in point contact with said spherical area.

4. The woodwind instrument as set forth in claim 1, in which said outer surface of said retainer is spherical, and said inner surface of said pad cup has a spherical area so that said outer surface of said retainer is held in point contact with said inner surface of said pad cup in said spherical area.

5. The woodwind instrument as set forth in claim 1, in which said coupler is adhesive compound so that said retainer is adhered to said pad cup in said appropriate attitude.

6. The woodwind instrument as set forth in claim 5, in which said adhesive compound is in liquid phase in an adjusting work on said retainer for adjusting said pad to said appropriate attitude through a relative motion between said retainer and said pad cup, and is solidified after said adjusting work.

7. The woodwind instrument as set forth in claim 6, in which the liquid adhesive compound is confined in a space between said pad cup and said pad snugly received in said recess.

8. The woodwind instrument as set forth in claim 1, in which said retainer has a backing plate portion having said inner surface and said outer surface and a column portion projecting from said inner surface at an invariable direction, and said fastener is engaged with said column portion for pressing said pad to said backing plate portion.

9. The woodwind instrument as set forth in claim 8, in which said fastener includes a pad washer pressed to said pad in parallel to said backing plate portion.

10. The woodwind instrument as set forth in claim 9, in which said fastener further includes a female screw formed in said column portion and a bolt engaged with said female screw for pressing said pad washer to said pad.

11. The woodwind instrument as set forth in claim 1, in which said tone holes are defined by tone hole chimneys fixed to said tube so that said pad is brought into contact with associated one of said tone hole chimneys for closing said tone hole.

12. The woodwind instrument as set forth in claim 11, in which said pad in said appropriate attitude is held in contact with the entire periphery of said associated one of said tone hole chimneys.

13. The woodwind instrument as set forth in claim 1, in which said retainer is formed with a recess defined by an inner surface serving as said outer surface, and said pad cup is formed with a projection held in said point-to-point contact with said inner surface defining said recess.

14. A woodwind instrument for generating tones, comprising:

a tube formed with plural tone holes for changing the pitch of said tones; and a key mechanism provided on the tube, and including a linkage secured to said tube and plural keys connected to said linkage for selectively close or open said tone holes, each of said plural keys including:

a pad cup having an inner surface defining a recess and connected to said linkage, a pad received in said recess and brought into contact with a part of said tube defining associated one of said tone holes, a retainer provided between said pad cup and said pad and having a backing plate portion held in area contact with said pad, a column portion projecting from said backing plate portion in an invariable direction, a contact portion held in point contact with said inner surface of said pad cup so as to permit said retainer to incline to any direction, a fastener connected to said column portion for pressing said pad to said backing plate portion, and a coupler provided between said retainer and said pad cup for keeping said retainer in an appropriate attitude in said pad cup.

15. The woodwind instrument as set forth in claim 14, in which said fastener includes a pad washer pressed to said pad in parallel to said backing plate portion.

16. The woodwind instrument as set forth in claim 15, in which said fastener further includes a female screw formed in said column portion and a bolt engaged with said female screw for pressing said pad washer to said pad.

17. The woodwind instrument as set forth in claim 14, in which said backing plate portion and said contact portion have an inner surface held in said area contact with said pad and an outer surface reverse to said inner surface and held in said point contact with said inner surface of said pad cup so that said retainer can incline in any direction on said inner surface of said pad cup before said coupler fixes said retainer to said pad cup.

18. The woodwind instrument as set forth in claim 17, in which said coupler is adhesive compound so that said retainer can incline in any direction before solidification of said adhesive compound.

* * * * *